US008935859B2

(12) United States Patent
Licht

(10) Patent No.: US 8,935,859 B2
(45) Date of Patent: Jan. 20, 2015

(54) INTERCHANGEABLE FOOTWEAR

(71) Applicant: Diane Licht, Manhattan Beach, CA (US)

(72) Inventor: Diane Licht, Manhattan Beach, CA (US)

( * ) Notice: Subject to any disclaimer, the term of this patent is extended or adjusted under 35 U.S.C. 154(b) by 0 days.

(21) Appl. No.: 13/944,647

(22) Filed: Jul. 17, 2013

(65) Prior Publication Data

US 2014/0075783 A1 Mar. 20, 2014

Related U.S. Application Data

(60) Provisional application No. 61/702,583, filed on Sep. 18, 2012.

(51) Int. Cl.

| | |
|---|---|
| ***A43B 3/12*** | (2006.01) |
| ***A43B 3/24*** | (2006.01) |
| ***A43B 1/00*** | (2006.01) |
| ***A43B 3/10*** | (2006.01) |

(52) U.S. Cl.

CPC . *A43B 3/12* (2013.01); *A43B 3/244* (2013.01); *A43B 1/0081* (2013.01); *A43B 3/103* (2013.01); *A43B 3/122* (2013.01)

USPC ..... 36/11.5; 36/15; 36/100

(58) Field of Classification Search

CPC ..... A43B 3/12; A43B 3/122; A43B 3/126; A43B 3/10; A43B 3/103; A43B 3/105; A43B 3/24; A43B 3/244

USPC ..... 36/11.5, 15, 100, 101

See application file for complete search history.

(56) References Cited

U.S. PATENT DOCUMENTS

| | | | | | |
|---|---|---|---|---|---|
| 1,213,030 | A * | 1/1917 | Skinner | 36/11.5 |
| 1,250,852 | A * | 12/1917 | Goldstone | 36/11.5 |
| D94,639 | S * | 2/1935 | Stritter | D2/935 |
| 2,112,761 | A * | 3/1938 | Buehner | 36/11.5 |
| 2,283,273 | A * | 5/1942 | Marcy | 36/11.5 |
| 2,421,818 | A * | 6/1947 | Tibiletti | 36/11.5 |
| 2,554,823 | A * | 5/1951 | Goldman | 36/11.5 |
| 2,583,826 | A * | 1/1952 | Fischer | 36/11.5 |
| 2,761,224 | A * | 9/1956 | Gardiner | 36/11.5 |
| 4,297,798 | A * | 11/1981 | Colan | 36/101 |
| 8,020,319 | B1 * | 9/2011 | Mohaupt | 36/101 |
| 8,230,621 | B2 * | 7/2012 | Shmurak et al. | 36/100 |
| 2006/0026861 | A1 * | 2/2006 | Manzi | 36/11.5 |
| 2009/0038181 | A1 * | 2/2009 | Loughnane | 36/94 |
| 2010/0132223 | A1 * | 6/2010 | Lewis | 36/101 |
| 2011/0239484 | A1 * | 10/2011 | Giovannetti | 36/11.5 |
| 2012/0204441 | A1 * | 8/2012 | Conner et al. | 36/11.5 |

* cited by examiner

*Primary Examiner* — Marie Bays

(57) ABSTRACT

An example interchangeable shoe in accordance with aspects of the present disclosure includes a sole, at least three fastening points, wherein each fastening point comprises a coupling mechanism, and at least one upper, wherein the at least one upper is attached to the shoe at the at least three fastening points using the coupling mechanisms.

13 Claims, 6 Drawing Sheets

INTERCHANGEABLE FOOTWEAR

BACKGROUND

Consumers usually own numerous styles of footwear for achieving a multitude of purposes, one of which being matching their footwear to their outfits. While one pair of shoe may match well with one outfit, it may not necessarily match a second outfit, considering the design, color and material of the footwear. Moreover, various accessories may be needed or desired on footwear, such as embellishments, different styles, widths, materials, design elements and colors.

Consumers are looking for ways to have more fashionable looks for less money. Accordingly, consumers buy clothing and accessories that can be easily and affordably be customized for every occasion and outfit. For example, there are watches designed to have removable straps, such that one watch can have several bands that are plastic, metal, leather or synthetic material. This flexibility allows a consumer to have one watch, but dozens of options.

BRIEF DESCRIPTION OF THE DRAWINGS

Example implementations are described in the following detailed description and in reference to the drawings, in which.

DETAILED DESCRIPTION

Various implementations described herein are directed to versatile footwear. More specifically, and as described in greater detail below, various aspects of the present disclosure are directed to a manner by which shoes with interchangeable components may be produced and used.

Aspects of the present disclosure described herein changes the look of a shoe by using different components (e.g., straps) through a plurality of mechanisms. According to various aspects of the present disclosure, the approach described herein allows a user to utilize a base shoe or sole to make various shoes that match different clothing combining the same base shoe or sole with different components through a plurality of mechanisms. Moreover, aspects of the present disclosure described herein also allow the user to use interchangeable components such as straps, tops or uppers to create shoes that may be different in color, material or/and style. Among other things, this approach may prevent the user from having to buy multiple shoes or sandals to match different outfits. Accordingly this approach allows the user to save money. Further, this approach allows the user to save space to store the shoes. Such aspects, among other things, decrease the amount of money needed to be spent on shoes or sandals, encourages creativity in terms of choosing a design and color for the shoe to be made and provide flexibility by increasing the number of options available to the user to pick from.

In one example in accordance with the present disclosure, a shoe with interchangeable components is provided. The shoe comprises a sole, at least three fastening points, wherein each fastening point comprises a coupling mechanism, and at least one upper, wherein the at least one upper is attached to the shoe at the at least three fastening points using the coupling mechanisms.

In another example in accordance with the present disclosure, a method for assembling a shoe with interchangeable components is provided. The method comprises providing a plurality of components of the shoe, the plurality of components comprising a sole, at least one upper and at least three fastening points, and providing a coupling mechanism at each of the at least three fastening points, wherein the at least one upper is attached to the shoe at the at least three fastening points using the coupling mechanisms.

Figure 1:
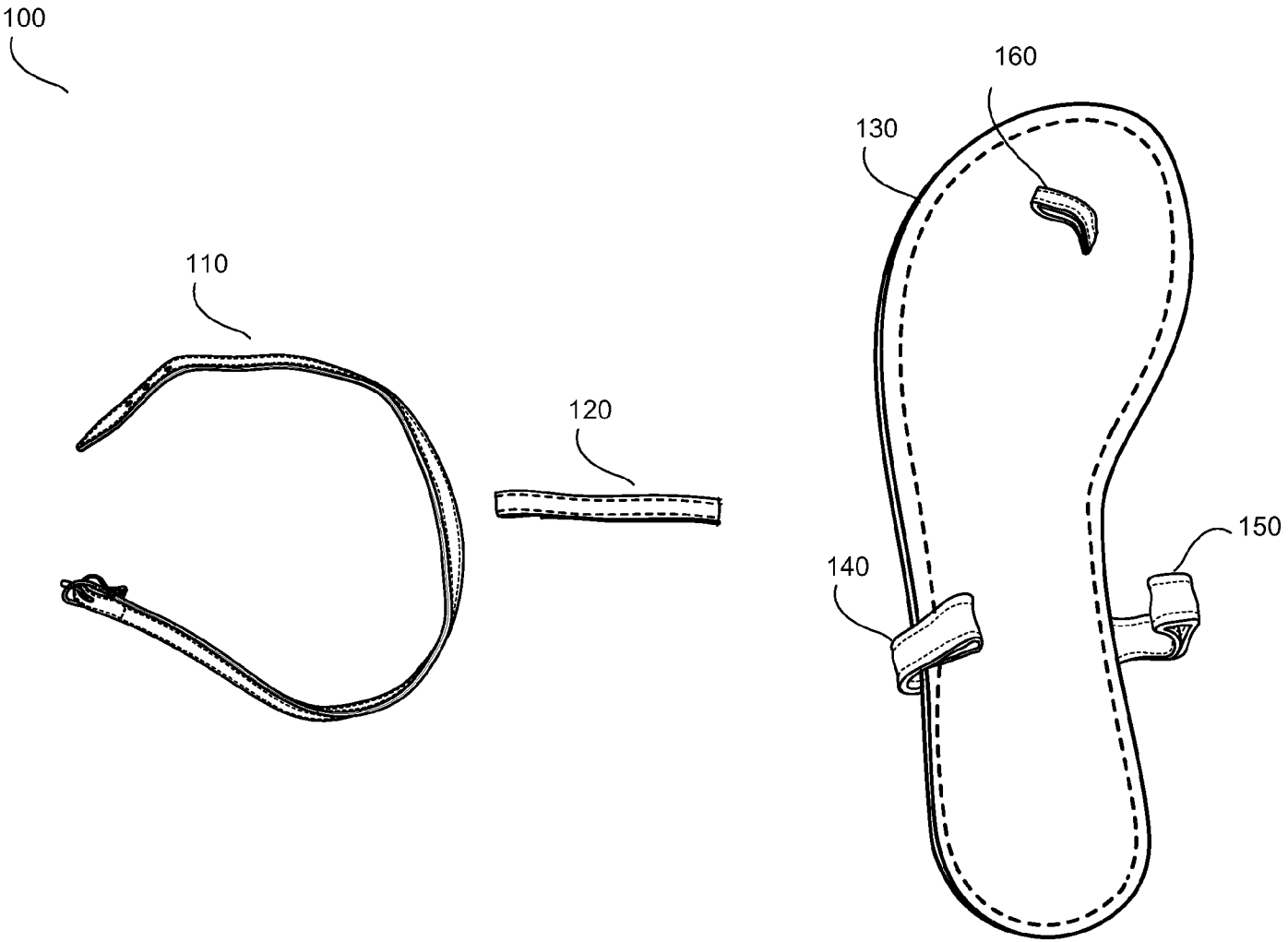
FIG. 1 illustrates a top plan view of example components of an example shoe in accordance with an implementation.

FIG. 1 illustrates example components of a shoe 100 in accordance with an implementation. It should be readily apparent that the shoe 100 illustrated in FIG. 1 represents a generalized depiction and that other components may be added or existing components may be removed, modified, or rearranged without departing from a scope of the present disclosure. The shoe 100 comprises a sole 130, two uppers 110 and 120, and three fastening points 140, 150 and 160, each of which is described in greater detail below. It should be readily apparent that while the shoe 100 illustrated in FIG. 1 includes two uppers, the system may actually comprise less or more than two uppers, and only two have been shown and described for simplicity.

The shoe 100 may be any footwear in the category of a sandal, thong, slip-on, clog, beach shoe or the like. In one implementation, a select segment (e.g., components) of the shoe may be interchangeable in its structure so as to provide for a change in the coloration, indicia, design, or to vary other appearance aspects of the shoe.

The uppers 110 and 120 may comprise a strap, vamp or alike. The uppers 110 and 120 vary in width, length and material. In one implementation, the uppers 110 and 120 may be made from leather, cloth, or alike. In another implementation, the upper may comprise large pieces of material (e.g., fabric) that covers the foot that the shoe may be worn on. In a further implementation, each upper may comprise at least one engaging mechanism that allows the upper to engage with the sole. Moreover, each upper may comprise a mechanism that allows the uppers to engage with one another.

The sole 130 may be a flat sole, a sole with a heel (e.g., small heel, high heel, wedge heel), an athletic sole and/or alike. Moreover, the sole 130 may be made from any suitable material, including synthetic materials, natural materials or a combination thereof.

The fastening points 140, 150 and 160 may be categorized based on their placement on the sole 120 of the shoe 100. More specifically, the fastening point 140 may be the left side fastening point while the fastening point 150 may be the right side fastening point and the fastening point 160 may be the front fastening point. In one implementation, each fastening point may have a coupling mechanism with an engaging loop. In one implementation, the front portion of an upper 120 may loop through the front fastening point (e.g., the fastening point 160).

Figure 2:
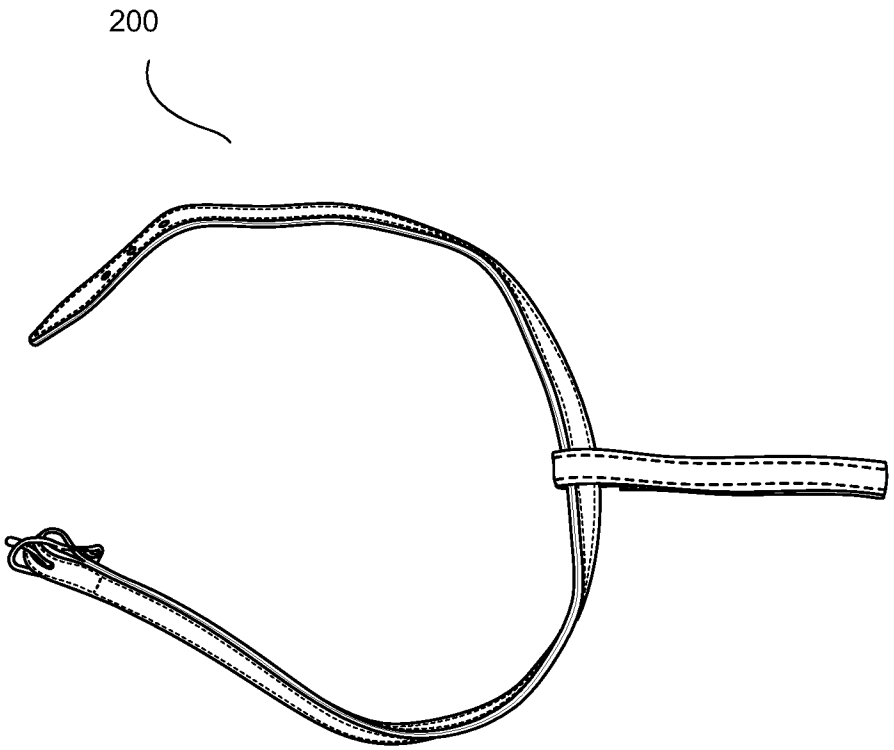
FIG. 2 illustrates example components of an example shoe in accordance with an implementation.

FIG. 2 illustrates an example upper system 200 in accordance with an implementation. As discussed above in reference to FIG. 1, the uppers 110 and 120 may have coupling mechanisms that allow them to engage with one another. The system 200 provides a configuration of the uppers 110 and 120 of FIG. 1. More specifically, the upper 110 is placed through the loop at one end of the upper 120. It should be readily apparent that the system 200 illustrated in FIG. 2 represents a generalized depiction and that other components may be added or existing components may be removed, modified, or rearranged without departing from a scope of the present disclosure. For example, in another implementation, the uppers 110 and 120 may not have loops, and the upper 110 may be snapped onto the upper 120.

Figure 3:
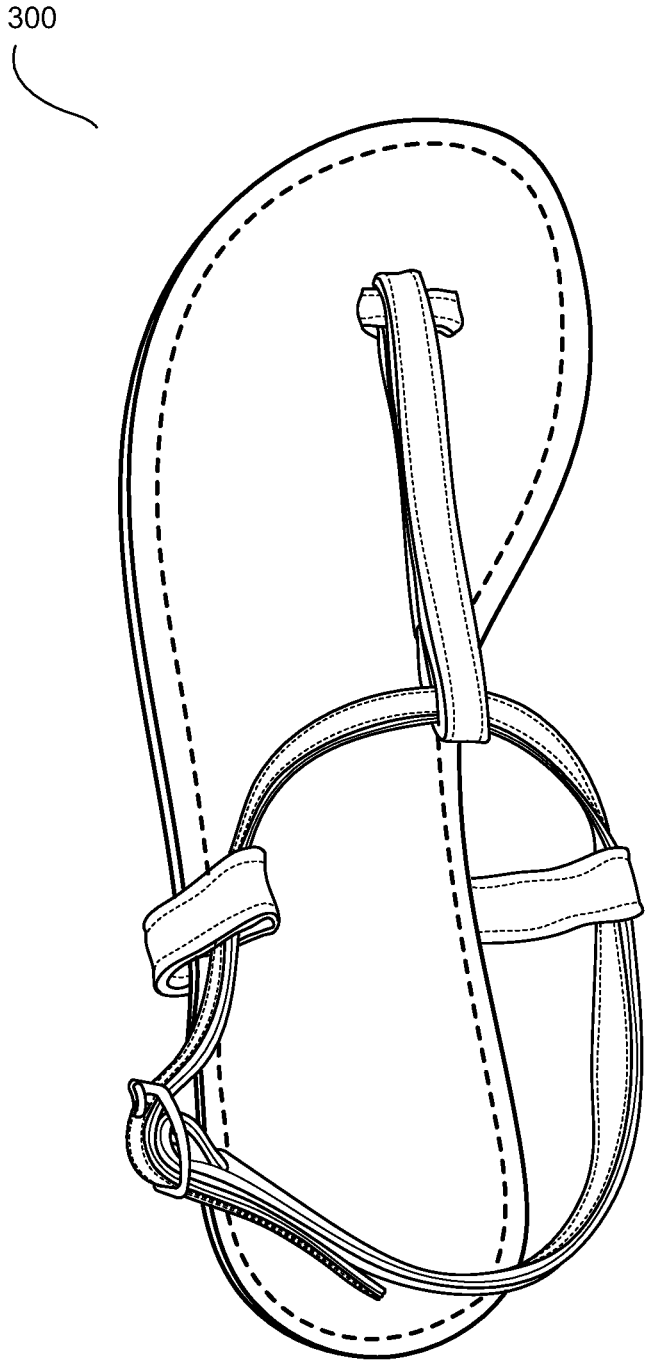
FIG. 3 illustrates a top plan view of an example shoe in accordance with an implementation.

FIG. 3 illustrates an example shoe 300 in accordance with an implementation. More specifically, the shoe 300 is one possible configuration of various components as described in more detail in reference to FIG. 1. Other implementations may comprise other configurations of a sole, at least one upper and at least three fastening points. Accordingly, it should be readily apparent that the shoe 300 illustrated in FIG. 3 represents a generalized depiction and that other components may be added or existing components may be removed, modified, or rearranged without departing from a scope of the present disclosure.

As discussed in more detail in reference to FIGS. 1 and 2, and illustrated in FIG. 3, to assemble the components of the shoe 300, the front portion of the upper 120 loops through the front fastening point 160 and snaps in place. The two ends of the upper 110 is fed through the back two loops on the right 150 and left 140 engaging points. The shoe 300 may be worn by a user after being assembled. More specifically, the upper may be wrapped around a user's ankle and can be buckled.

Figure 4C:
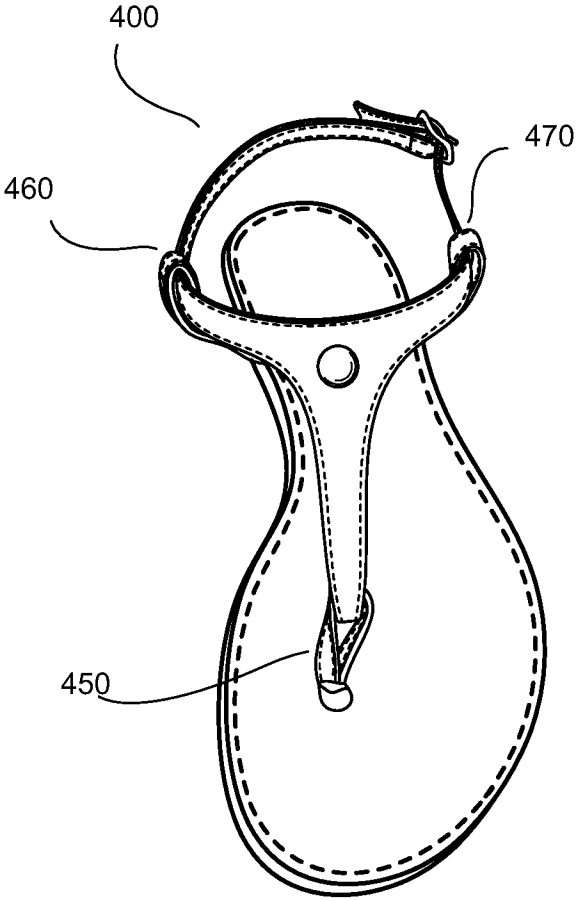
FIGS. 4A, 4B and 4C illustrate a top plan view of example components of an example shoe in accordance with an implementation.

FIG. 4C illustrates an example shoe 400 in accordance with an implementation. More specifically, the shoe 400 is one possible configuration of various components as described in more detail in reference to FIGS. 4A and 4B. Other implementations may comprise other configurations of a sole, at least one upper and at least three fastening points. Accordingly, it should be readily apparent that the shoe 400 illustrated in FIG. 4C represents a generalized depiction and that other components may be added or existing components may be removed, modified, or rearranged without departing from a scope of the present disclosure.

Figure 4B:
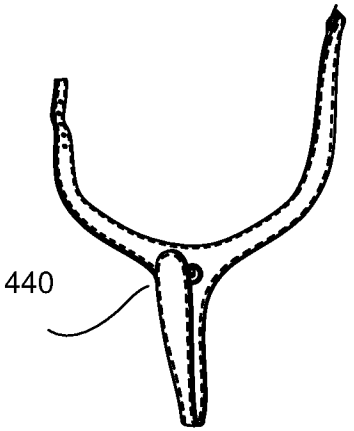
Figure 4A:
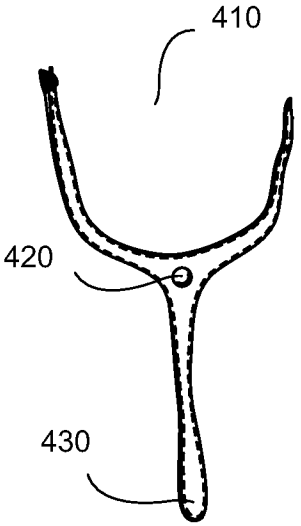

Similar to the example shoe 300 illustrated in FIG. 3, the shoe 400 uses three engaging points 450, 460 and 470. The piece 410 shown in FIG. 4A slides through the three engaging points 450, 460 and 470. Further, the parts 420 and 430 may engage to close. Such engagement may be, but not limited to, a snap mechanism. The end look is shown in FIG. 4B. The parts 420 and 430 meet at part 440.

Figure 5A:
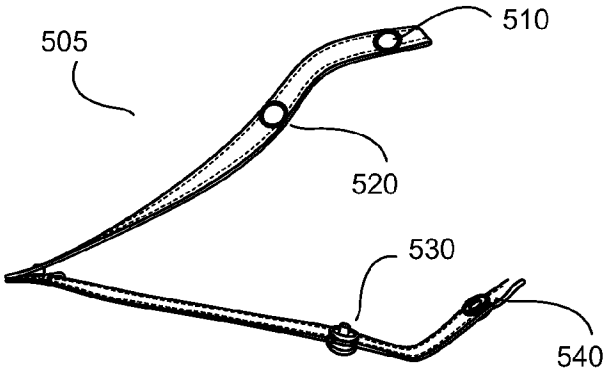
FIGS. 5A, 5B and 5C illustrate a top plan view of example components of an example shoe in accordance with an implementation.
Figure 5B:
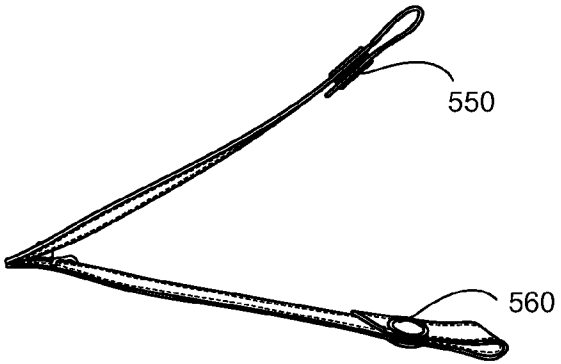
Figure 5C:
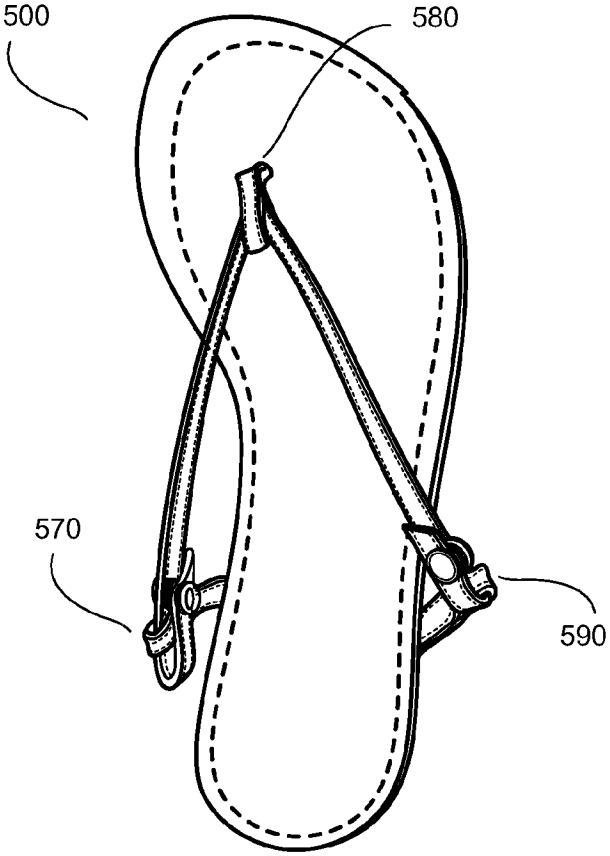

FIG. 5C illustrates an example shoe 500 in accordance with an implementation. More specifically, the shoe 500 is one possible configuration of various components as described in more detail in reference to FIGS. 5A and 5B. Other implementations may comprise other configurations of a sole, at least one upper and at least three fastening points. Accordingly, it should be readily apparent that the shoe 500 illustrated in FIG. 5C represents a generalized depiction and that other components may be added or existing components may be removed, modified, or rearranged without departing from a scope of the present disclosure.

Similar to the example shoes 300 and 400 illustrated in FIGS. 3 and 4, the shoe 500 uses three engaging points 570, 580 and 590. A piece 505 as illustrated in FIG. 5A slides through the three engaging points 570, 580 and 590. Further, parts 510 and 520 may engage to close, and parts 530 and 540 may engage to close. Such engagements may be, but not limited to, snap mechanisms. The end look is shown in FIG. 5B. The parts 510 and 520 meet at a part 550, and the parts 530 and 540 meet at a part 560.

Figure 6:
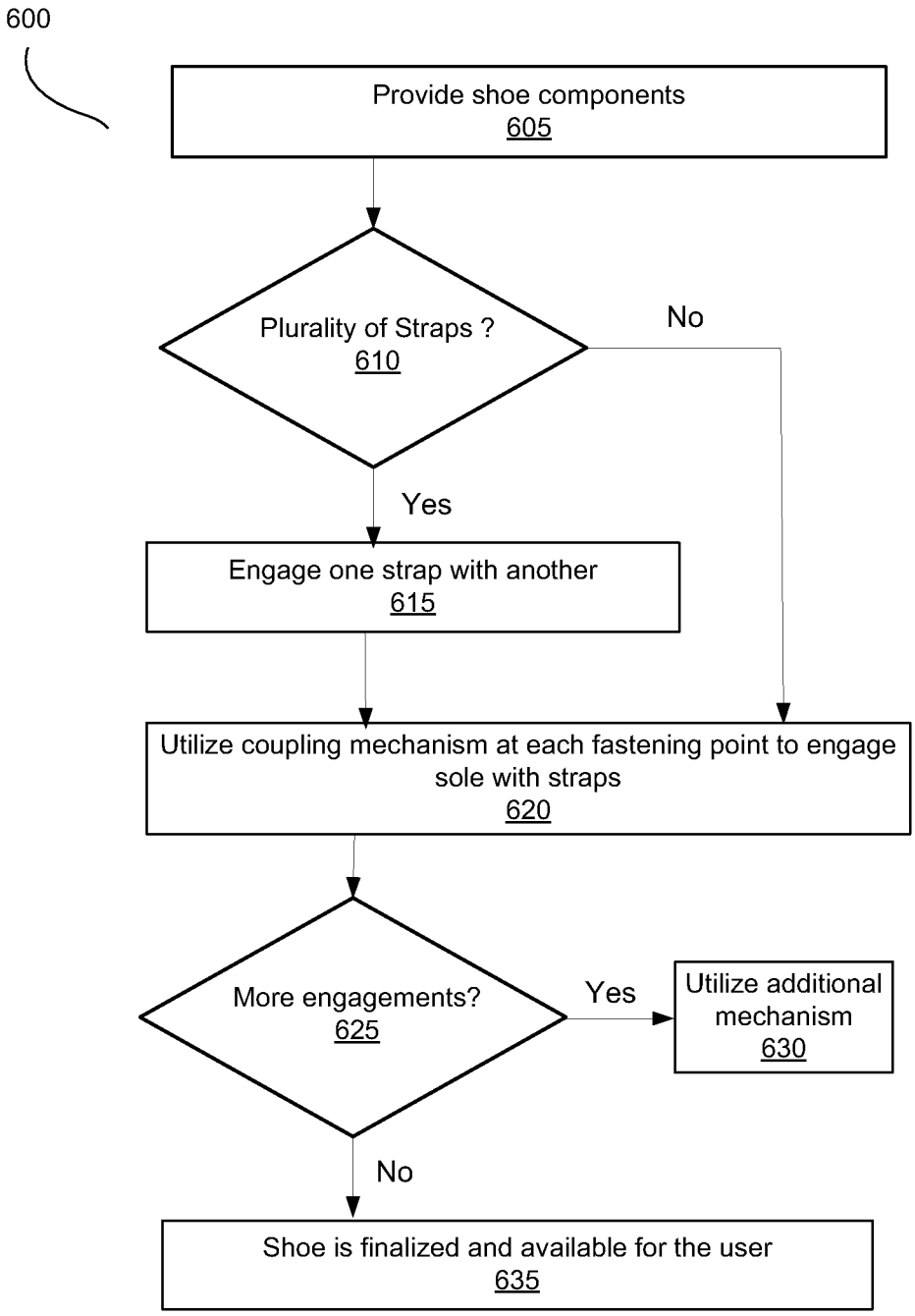
FIG. 6 illustrates an example process flow diagram in accordance with an implementation.

Turning now to the assembly process of the shoe 100, FIG. 6 illustrates an example process flow diagram 600 in accordance with an implementation. It should be readily apparent that the processes illustrated in FIG. 6 represents generalized illustrations, and that other processes may be added or existing processes may be removed, modified, or rearranged without departing from the scope and spirit of the present disclosure.

The process 600 may begin at block 605, where the sole and uppers are provided. In particular, this process may involve identifying a sole and at least one upper to be used to assemble a shoe desired by a user. In one implementation, the user may choose various components of the shoe. In another implementation, the components of the shoe may be identified by the shoe manufacturer and provided to the user.

At block 610, it is determined whether a plurality of uppers is provided. In the event that there are multiple uppers, at block 615, a mechanism may be utilized to engage one upper with another. For example, an upper may be placed through an engaging mechanism (e.g., loop, snap) at one end of another upper. In the event that there is a single upper, the process proceeds to block 620. At block 620, a coupling mechanism is utilized at each fastening point to engage the sole of the shoe with the uppers. In one implementation, each upper may be looped through a fastening point on the sole of the shoe.

At block 625, it is determined whether any additional engaging mechanisms need to be utilized to finalize the assembly of the shoe. For example, there may be an engaging mechanism that snaps one segment of the upper to another segment of the upper after all the uppers are looped through the fastening points. In the event that additional engaging mechanisms are needed, the process proceeds to block 630, where such mechanisms are utilized.

At block 635, the assembled shoe is available to be worn by the user. This process may involve the user wrapping the upper around the user's ankle and buckling or adjusting it for a comfortable fit.

The present disclosure has been shown and described with reference to the foregoing exemplary implementations. It is to be understood, however, that other forms, details, and examples may be made without departing from the spirit and scope of the disclosure that is defined in the following claims. As such, all examples are deemed to be non-limiting throughout this disclosure.

What is claimed is:

1. A shoe with interchangeable parts, comprising:

a sole;

at least three fastening points, wherein each fastening point comprises a coupling mechanism of an engaging loop; and a first upper element encircling an ankle of a user of the shoe and connected to the shoe at at least two fastening points using engaging loops;

a second upper element connected to the sole through at least one front loop on the sole;

an engaging mechanism on the first upper element, wherein the engaging mechanism connects one end of the first upper element to the other end of the first upper element.

2. The shoe of claim 1, wherein the first and second upper elements are slid through the engaging loop to connect with the sole.

3. The shoe of claim 1, wherein the engaging mechanism comprises a loop, a snap, a hook and loop, a magnet or a tie system.

4. The shoe of claim 1, wherein the sole is a flat sole, a sole with a heel or wedge or an athletic sole.

5. The shoe of claim 1, further comprising a second engaging mechanism utilized to engage the first upper element with the second upper element.

6. The shoe of claim 1, wherein the second engaging mechanism comprises a loop, a snap, a hook and loop, a magnet or a tie system.

7. The shoe of claim 1, wherein the first and second upper elements are seamed, stitched or bound together.

8. A method for assembling a shoe with interchangeable parts, comprising:

providing a plurality of components of the shoe, the plurality of components comprising a sole, a first upper element, a second upper element and at least three fastening points; and providing a coupling mechanism of an engaging loop at each of the at least three fastening points, wherein the first and second upper elements are attached to the shoe at the at least three fastening points using engaging loops, and wherein the first upper element is fastened using an engaging mechanism connecting one end of the first upper element to another end of the first upper element.

9. The method of claim 8, further comprising allowing a user of the shoe to wrap the first upper element around the user's ankle and buckle.

10. The method of claim 8, further comprising providing the engaging mechanism acting as a part of the first upper element, wherein the engaging mechanism may connect one end of the first upper element with the other end of the first upper element around the ankle of a user of the shoe.

11. The method of claim 8, further comprising allowing a user to select the plurality of components of the shoe.

12. The method of claim 11, wherein the plurality of components of the shoe comprise different styles, widths, materials, design elements and colors.

13. The method of claim 8, further comprising utilizing an engaging mechanism connecting a part of the first upper elements to a part of the second upper element.

* * * * *